US008593479B2

(12) United States Patent
Park et al.

(10) Patent No.: US 8,593,479 B2
(45) Date of Patent: Nov. 26, 2013

(54) METHOD OF CORRECTING PREFERRED COLOR AND DISPLAY DEVICE USING THE SAME

(75) Inventors: Taeyong Park, Paju-si (KR); Gihong Kim, Goyang-si (KR)

(73) Assignee: LG Display Co., Ltd., Seoul (KR)

( * ) Notice: Subject to any disclaimer, the term of this patent is extended or adjusted under 35 U.S.C. 154(b) by 935 days.

(21) Appl. No.: 12/588,455

(22) Filed: Oct. 15, 2009

(65) Prior Publication Data

US 2011/0007088 A1 Jan. 13, 2011

(30) Foreign Application Priority Data

Jul. 10, 2009 (KR) ..... 10-2009-0063113

(51) Int. Cl.
*G09G 5/02* (2006.01)

(52) U.S. Cl.
USPC ..... 345/590; 345/589

(58) Field of Classification Search
USPC ..... 345/589, 590
See application file for complete search history.

(56) References Cited

U.S. PATENT DOCUMENTS 6,058,208 A * 5/2000 Ikeda et al. ..... 382/167
7,034,959 B1 * 4/2006 Takemoto ..... 358/1.9
2004/0174389 A1 * 9/2004 Ben-David et al. ..... 345/694
2005/0024662 A1 * 2/2005 Yamada ..... 358/1.9
2005/0134785 A1 * 6/2005 Roth et al. ..... 349/144
2005/0225575 A1 * 10/2005 Brown Elliott et al. ..... 345/694
2005/0276474 A1 * 12/2005 Um et al. ..... 382/167
2006/0061786 A1 * 3/2006 Cho et al. ..... 358/1.9
2006/0170940 A1 * 8/2006 Kang et al. ..... 358/1.9
2007/0064422 A1 * 3/2007 Murai ..... 362/231
2007/0257946 A1 * 11/2007 Miller et al. ..... 345/694
2009/0009539 A1 * 1/2009 Ahn et al. ..... 345/690
2009/0059326 A1 * 3/2009 Hong ..... 358/518
2009/0167657 A1 * 7/2009 Tomizawa ..... 345/88
2010/0008427 A1 * 1/2010 Chiu et al. ..... 375/240.18

* cited by examiner

*Primary Examiner* — David T Welch
(74) *Attorney, Agent, or Firm* — McKenna Long & Aldridge LLP

(57) ABSTRACT

A method of correcting a preferred color is disclosed. The method includes converting an input image including multi-primary color data of three or more primary colors into an XYZ color space, converting the XYZ color space into data of an LCH color space, expanding a color gamut of the data in the LCH color space to detect a preferred color region of the color gamut expansion data, correcting data of the preferred color region using parameters independent of the input image, inversely converting the corrected data of the preferred color region of the color gamut expansion data into an XYZ color space, dividing the XYZ color space into multi-primary color data of four or more primary colors, and displaying the multi-primary color data on a display device.

7 Claims, 4 Drawing Sheets

METHOD OF CORRECTING PREFERRED COLOR AND DISPLAY DEVICE USING THE SAME

This application claims the benefit of Korea Patent Application No. 10-2009-0063113 filed on Jul. 10, 2009, the entire contents of which is incorporated herein by reference for all purposes as if fully set forth herein.

BACKGROUND OF THE INVENTION

1. Field of the Invention

Embodiments of the invention relate to a method of correcting a preferred color using previously determined parameters without performing an analysis process of an input image and a display device capable of increasing display quality using the correcting method.

2. Discussion of the Related Art

Various flat panel displays whose weight and size are smaller than cathode ray tubes have been developed. Examples of the flat panel displays include a liquid crystal display (LCD), a field emission display (FED), a plasma display panel (PDP), and an electroluminescence device (EL). The electroluminescence device includes an organic light emitting diode (OLED).

In an active matrix thin film transistor (AM TFT) LCD, a TFT is formed in each pixel. The AM TFT LCD has been implemented in televisions as well as display devices in portable devices, such as office equipment and computers. Accordingly, cathode ray tubes are being rapidly replaced by the AM TFT LCD.

Display quality of display devices has been evaluated by subjective evaluation of a viewer about a preferred color reproduction. A preferred color correcting technology has been used to increase the display quality of the display devices.

There are a region correcting method and a point correcting method as the preferred color correcting method. For example, "Preferred Skin Color Reproduction Based on Adaptive Affine Transform" (IEEE Transactions on Consumer Electronics, Vol. 51, No. 1, pp 191-197, 2005) corresponding to the region correcting method, "Skin color reproduction algorithm for portrait images shown on the mobile display" (SPIE vol. 6058, pp 1-8) corresponding to the point correcting method, and the like, are well known. In the region correcting method, an input color range and a preferred color range are determined as an oval shape in u'v' chromaticity coordinates, and then the input color range is mapped to the preferred color range. In the point correcting method, a target is selected as one point of a color space, and an input color is corrected to a color similar to the target. However, in the region correcting method, a contour noise is generated, and a luminance is reduced because there is no brightness correction. In the point correcting method, a preferred color correction performance is reduced because content of an input image is not considered. So as to solve the problems of the contour noise and the luminance reduction generated in the existing preferred color correcting method, an average value of a preferred color in the chromaticity coordinates and a preferred color correcting method according to a reference value of the preferred color were proposed through Korea Patent Application No. 10-2007-0061992 (Jun. 25, 2007) corresponding to the present applicant, and which are hereby incorporated by reference in their entirety.

The preferred color correcting method has recently developed greatly, but problems to be solved still remain. Thus, it is difficult to achieve the preferred color correcting method in the liquid crystal display. Most of preferred color correcting methods are implemented through the following two processes (1) and (2).

The first process (1) is a conversion process into a uniform color space for preferred color mapping by correcting each of brightness "L", chroma "C", and hue "H". A complex operational process is necessary in the conversion process, and thus complexity of hardware and processing time are excessively delayed.

The second process (2) is a process for detecting a preferred color region in an input image frame or analyzing a color distribution so as to design a preferred color conversion module. The preferred color conversion module may be divided into a module for analyzing a color distribution of an input image, a module for extracting primary colors based on an analysis result, a module for determining a conversion region to be processed in a color space based on a distribution of the primary colors extracted from the input image, a module for converting a color belonging to the conversion region among colors constituting the input image, and the like. Because it is difficult to implement the preferred color conversion module as a lookup table, it is difficult to real-time perform the existing preferred color correcting method. Further, it is difficult to perform multi-primary color reproduction.

SUMMARY OF THE INVENTION

Embodiments of the invention provide a method of correcting a preferred color and a display device using the method capable of performing real-time processing and increasing display quality of a preferred color of a multi-primary color display.

In one aspect, there is a method of correcting a preferred color comprising converting an input image including multi-primary color data of three or more primary colors into an XYZ color space and converting the XYZ color space into data of an LCH color space; expanding a color gamut of the data in the LCH color space to detect a preferred color region of the color gamut expansion data and correcting data of the preferred color region using parameters independent of the input image; inversely converting the corrected data of the preferred color region of the color gamut expansion data into an XYZ color space and dividing the XYZ color space into multi-primary color data of four or more primary colors; and displaying the multi-primary color data on a display device.

In another aspect, there is a display device comprising a display panel that displays multi-primary color data of four or more primary colors; a display panel driving circuit that displays the multi-primary color data on the display panel; a storing unit that stores parameters independent of an input image; and a color gamut expansion and preferred color correcting unit that receives an input image including multi-primary color data of three or more primary colors to convert data of the input image into an XYZ color space, converts the XYZ color space into data of an LCH color space, expands a color gamut of the data of the input image in the LCH color space, corrects data of a preferred color region using the parameters, and divides the corrected data of the preferred color region into multi-primary color data of four or more primary colors to supply the multi-primary color data to the display panel driving circuit.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention. In the drawings.

DETAILED DESCRIPTION OF THE EMBODIMENTS

Reference will now be made in detail embodiments of the invention examples of which are illustrated in the accompanying drawings.

Figure 1:
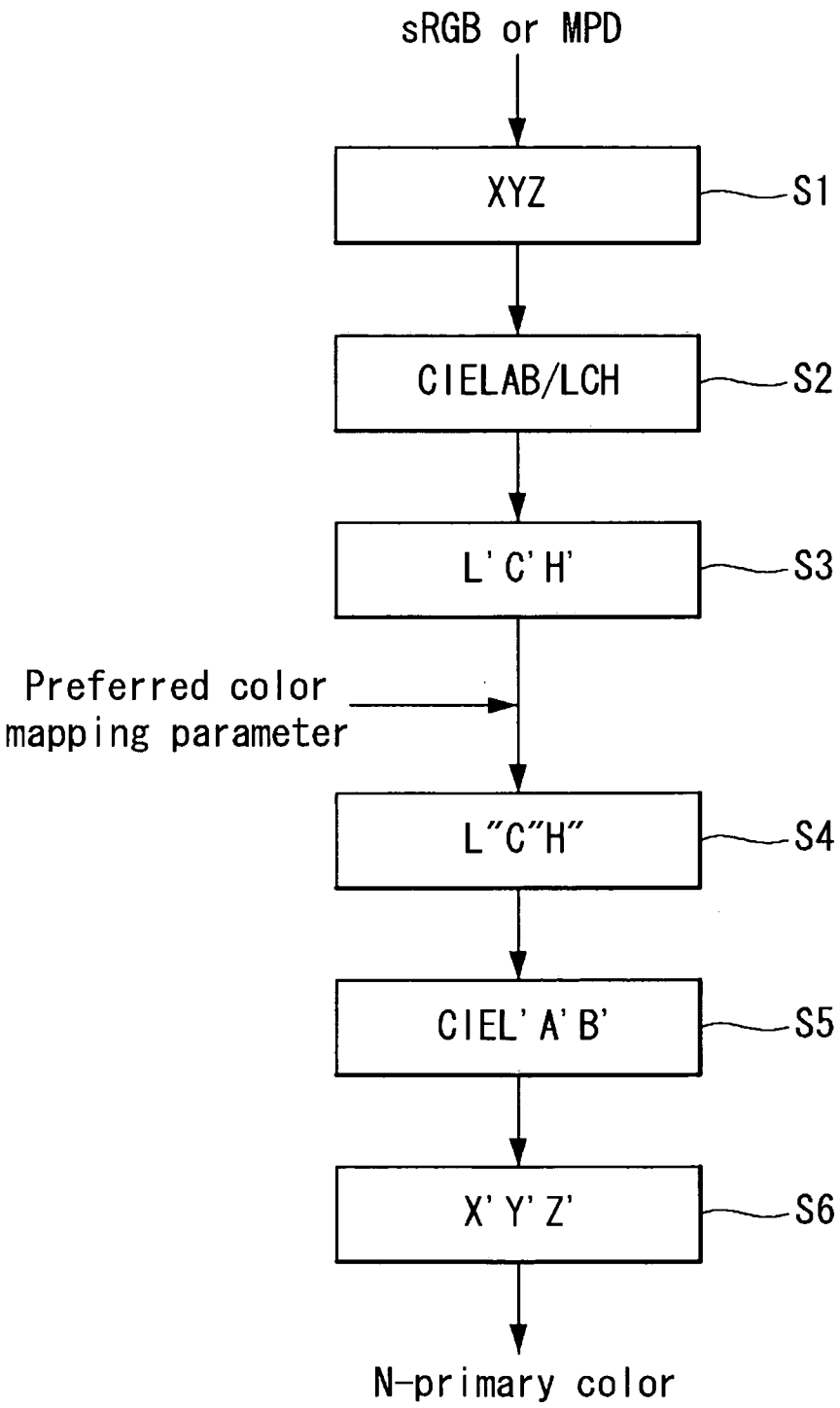
FIG. 1 is a flow chart illustrating in stages a method of correcting a preferred color according to an embodiment of the invention.

FIG. 1 is a flow chart illustrating in stages a method of correcting a preferred color according to an embodiment of the invention.

As shown in FIG. 1, the method of correcting the preferred color according to the embodiment of the invention includes receiving data sRGB of three primary colors RGB including red (R), green (G), and blue (B) or data of multi-primary colors to convert the three primary color data sRGB or the multi-primary color data into an XYZ color space in step S1. The multi-primary color data is data of three or more primary colors. For example, at least one of yellow (Y), cyan (C), and magenta (M) may be added to the three primary colors RGB.

(1) Method for Converting the Three Primary Color Data sRGB into the XYZ Color Space A method for converting the RGB data sRGB into the XYZ color space includes a normalization algorithm indicated in Equation 1, a de-gamma conversion algorithm indicated in Equation 2, and an XYZ conversion algorithm indicated in Equation 3.

$$R'_{sRGB}=R_{8bit}\div 255.0$$

$$G'_{sRGB}=G_{8bit}\div 255.0$$

$$B'_{sRGB}=B_{8bit}\div 255.0 \qquad \text{[Equation 1]}$$

In Equation 1, each of $R_{8bit}$, $G_{8bit}$, and $B_{8bit}$ is 8-bit nonlinear RGB input signal having a digital data value between 0 and 255. Each of $R'_{sRGB}$, $G'_{sRGB}$, and $B'_{sRGB}$ is a normalized nonlinear RGB input signal having a logical value of 0~1.

$$\text{if } R'_{sRGB}, G'_{sRGB}, B'_{sRGB} \le 0.04045$$

$$R_{sRGB}=R'_{sRGB}\div 12.92$$

$$G_{sRGB}=G'_{sRGB}\div 12.92$$

$$\text{else}$$

$$R_{sRGB}=[(R'_{sRGB}+0.055)/1.055]^{2.4}$$

$$G_{sRGB}=[(G'_{sRGB}+0.055)/1.055]^{2.4}$$

$$B_{sRGB}=[(B'_{sRGB}+0.055)/1.055]^{2.4} \qquad \text{[Equation 2]}$$

In Equation 2, each of $R_{sRGB}$, $G_{sRGB}$, and $B_{sRGB}$ is a de-gammaed linear RGB input signal having a logical value of 0~1.

$$\begin{bmatrix} X \\ Y \\ Z \end{bmatrix} = \begin{bmatrix} 0.4124 & 0.3576 & 0.1805 \\ 0.2126 & 0.7152 & 0.0722 \\ 0.0193 & 0.1192 & 0.9505 \end{bmatrix} \begin{bmatrix} R_{sRGB} \\ G_{sRGB} \\ B_{sRGB} \end{bmatrix} \qquad \text{[Equation 3]}$$

In Equation 3, each of X, Y, and Z is CIE 1931 XYZ tristimulus value converted by a 3×3 matrix.

(2) Method for Converting the Multi-Primary Color Data into the XYZ Color Space

The multi-primary color data is converted into the XYZ color space through algorithms indicated in Equation 4 and Equation 5.

$$\begin{bmatrix} X \\ Y \\ Z \end{bmatrix} = \begin{bmatrix} X_{1,max} & X_{2,max} & \dots & X_{n,max} \\ Y_{1,max} & Y_{2,max} & \dots & Y_{n,max} \\ Z_{1,max} & Z_{2,max} & \dots & Z_{n,max} \end{bmatrix} \begin{bmatrix} S_1 \\ S_2 \\ \vdots \\ S_n \end{bmatrix} \qquad \text{[Equation 4]}$$

$$Y_w = Y_{1,max} + Y_{2,max} + \dots + Y_{n,max} \qquad \text{[Equation 5]}$$

In Equation 4, $[X_{i,max}\ Y_{i,max}\ Z_{i,max}]$ indicates CIE 1931 XYZ tristimulus value of an i-th primary color, i.e., a XYZ color value specified in the XYZ color space measured using a measuring device after representing a color in a multi-primary color display (MPD). In Equations 4 and 5, n is the number of primary colors. For example, if each of pixels of the multi-primary color display includes 4 subpixels of R, G, B, and C, n is 4 and Equation 4 is expressed by Equation 6. In Equation 4, Si indicates a driving signal driving the i-th primary color. The driving signal Si has a scalar value between zero and one (i.e., $0 \le Si \le 1$) and is related to TRC(di). TRC is the abbreviation of a tone reproduction curve, and di is a digital data value between 0 and 255 (i.e., $0 \le di \le 255$) driving the multi-primary color display. In Equation 5, Yw indicates a luminance value in CIE 1931 XYZ tristimulus value of white.

$$\begin{bmatrix} X \\ Y \\ Z \end{bmatrix} = \begin{bmatrix} X_{1,max} & X_{2,max} & X_{3,max} & X_{4,max} \\ Y_{1,max} & Y_{2,max} & Y_{3,max} & Y_{4,max} \\ Z_{1,max} & Z_{2,max} & Z_{3,max} & Z_{4,max} \end{bmatrix} \begin{bmatrix} S_1 \\ S_2 \\ S_3 \\ S_4 \end{bmatrix} \qquad \text{[Equation 6]}$$

Referring again to FIG. 1, the method of correcting the preferred color according to the embodiment of the invention includes converting the X, Y, and Z color values into CIELAB (L*a*b*) value using CIELAB conversion algorithm indicated in Equation 7 and then converting the CIELAB value into CIELCH (where L: lightness, C: chroma, H: hue) value using an algorithm indicated in Equation 8 in step S2 so as to convert the CIELAB value into a uniform color space.

$$L^* = 116 \cdot f\left(\frac{Y}{Y_n}\right) - 16 \qquad \text{[Equation 7]}$$

$$a^* = 500 \cdot \left[f\left(\frac{X}{X_n}\right) - f\left(\frac{Y}{Y_n}\right)\right]$$

$$b^* = 200 \cdot \left[f\left(\frac{Y}{Y_n}\right) - f\left(\frac{Z}{Z_n}\right)\right]$$

-continued where, $$f(x) = \begin{cases} x^{1/3}, & x > 0.008856 \\ 7.787x + \frac{16}{116}, & x \le 0.008856 \end{cases}$$

In Equation 7, each of Xn, Yn, and Zn is a tristimulus value of reference white, i.e., CIE 1931 XYZ tristimulus value for white of each of the RGB data sRGB and the multi-primary color data.

$$L^* = L^* \quad \text{[Equation 8]}$$

$$C = \sqrt{(a^*)^2 + (b^*)^2}$$

$$H = \tan^{-1}\left(\frac{b^*}{a^*}\right)$$

Referring again to FIG. 1, the method of correcting the preferred color according to the embodiment of the invention includes expanding a color gamut of the LCH value calculated in step S2 to L'C'H' using various known color gamut expansion algorithms in step S3. There is a linear chroma expansion method as an example of the color gamut expansion algorithms. The linear chroma expansion method is described by the following Equation 9.

$$L' = L \quad \text{[Equation 9]}$$

$$C' = \frac{C_{MPD,max}}{C_{sRGB,max}} C, \quad (0 \le C \le C_{sRGB,max})$$

$$H' = H$$

In Equation 9, $C_{sRGB,max}$ is a chroma value of a color gamut boundary of the RGB data sRGB having the same color, the same hue angle, and the same lightness as a color of the input image. $C_{MPD,max}$ is a chroma value of a color gamut boundary of the multi-primary color display having the same color, the same hue angle, and the same lightness as the color of the input image.

Referring again to FIG. 1, the method of correcting the preferred color according to the embodiment of the invention includes detecting a preferred color from the input image of the L'C'H' value, to which the color gamut expansion algorithm is applied, using a preferred color detection algorithm indicated in Equation 10 and then applying a preferred color mapping algorithm indicated in Equation 11, that is a function obtained using parameters optimized through preliminarily recognition experiments, to the preferred color to adjust the preferred color to L"C"H" value in step S4. In the related art, a preferred color is corrected using image-dependent parameters extracted according to an analysis result of an input image. On the other hand, in the embodiment of the invention, the preferred color is corrected using image-independent parameters determined by preliminarily experiments conducted on a large number of sample images. Accordingly, it is noted in the invention that the preferred color is corrected by correcting the L'C'H' value using the image-independent parameters that are determined by the preliminarily recognition experiments without performing an analysis process of the input image and are previously stored in a memory.

$$w = e^{-\left[\left(\frac{L'-L_m}{\sigma_L}\right)^2 + \left(\frac{C'-C_m}{\sigma_C}\right)^2 + \left(\frac{H'-H_m}{\sigma_H}\right)^2\right]} \quad \text{[Equation 10]}$$

In Equation 10, w is a weight value of Gaussian probability model. The preferred color may be selected depending on the weight value w. For example, a skin color portion in the input image is calculated at the weight value w between 0 and 1.

$$L'' = L' + k \cdot (L_t - L_m) \cdot w^\gamma$$

$$C'' = C' + k \cdot (C_t - C_m) \cdot w^\gamma$$

$$H'' = H' + k \cdot (H_t - H_m) \cdot w^\gamma \quad \text{[Equation 11]}$$

In Equation 11, k is a constant for adjusting a corrected amount of preferred color mapping, and γ is a constant for soft adjusting a boundary portion between the preferred color and a non-preferred color. Each of Lm, Cm, and Hm is an average value of preferred color distributions in a CIELCH space extracted from many images through the preliminarily recognition experiments. σL, σC, and σH is a standard deviation value of the preferred color distributions in the CIELCH space extracted from the many images through the preliminarily recognition experiments. Each of Lt, Ct, and Ht is an average value of a preferred skin color of an observer (i.e., a corrected target value of the preferred color) in the multi-primary color display through the preliminarily recognition experiments. The parameters are independent of the input image and are previously stored in the memory. In the embodiment of the invention, the preferred color to be corrected in the preferred color mapping algorithm includes various colors, such as a skin color, a grass color, a sky color, and a sea color. A kind of the preferred color may be selected depending on the parameters such as Lm, Cm, Hm, σL, σC, and σH.

Referring again to FIG. 1, the method of correcting the preferred color according to the embodiment of the invention includes converting the L"C"H" value to which the color gamut expansion algorithm and the preferred color mapping algorithm are sequentially applied in the uniform color space into L*a*b* value through an inverse conversion algorithm of CIEL'A'B' indicated in the following Equation 12 in step S5 and then inversely converting the L*a*b* value into XYZ color value through an inverse conversion algorithm of CIEX'Y'Z' indicated in Equation 13 in step S6.

$$L^* = L'' \quad \text{[Equation 12]}$$

$$a^* = C'' \cos H''$$

$$b^* = C'' \sin H''$$

$$X = x_r X_n \quad \text{[Equation 13]}$$

$$k = 903.3$$

$$Y = y_r Y_n$$

$$\varepsilon = 0.008856$$

$$Z = z_r Z_n$$

where $$x_r = \begin{cases} f_x^3, & f_x^3 > \varepsilon \\ (116 f_x - 16)/k, & f_x^3 \le \varepsilon \end{cases}$$

-continued $$y_r = \begin{cases} ((L^* + 16)/116)^3, & L^* > k\varepsilon \\ L^*/k, & L^* \le k\varepsilon \end{cases}$$

$$z_r = \begin{cases} f_z^3, & f_z^3 > \varepsilon \\ (116 f_z - 16)/k, & f_z^3 \le \varepsilon \end{cases}$$

$$f_y = (L^* + 16)/116$$

$$f_x = \frac{a^*}{500} + f_y$$

$$f_z = f_y - \frac{b^*}{200}$$

Referring again to FIG. 1, the method of correcting the preferred color according to the embodiment of the invention includes converting the XYZ color value calculated using the known multi-primary color conversion algorithm, such as a matrix switching method and a linear interpolation on equi-luminance plane method (LIQUID), as indicated in the inverse conversion of the above Equation 6 into data S1, S2, . . . , SN of n multi-primary colors (where, n is an integer equal to or greater than 3) in step S6.

An input/output relationship between all of processes including the color space conversion, the color space inverse conversion, the color gamut expansion algorithm, and the preferred color mapping algorithm implemented in steps S1 to S6 may be achieved through a lookup table. The lookup table and the preferred color mapping parameters may be stored in one electrically erasable programmable read-only memory (EEPROM). Accordingly, an operational algorithm of the lookup table and the preferred color mapping parameters may be adjusted by connecting the EEPROM to a ROM writer to change/update data of the EEPROM.

Figure 2:
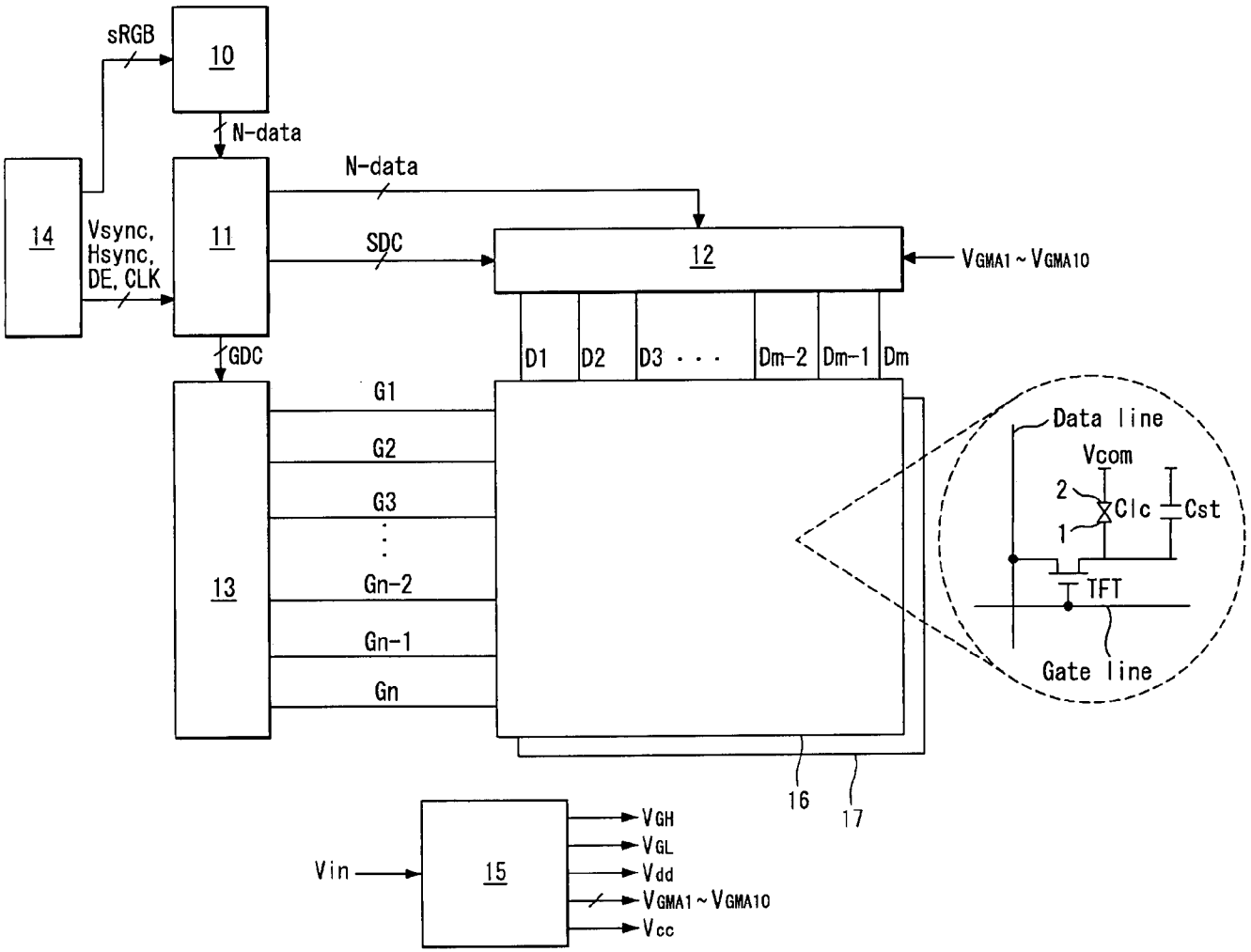
FIG. 2 is a block diagram showing an active matrix thin film transistor liquid crystal display (AM TFT LCD) according to an embodiment of the invention.

FIG. 2 is a block diagram showing an active matrix thin film transistor liquid crystal display (AM TFT LCD) according to an embodiment of the invention.

As shown in FIG. 2, the AM TFT LCD according to the embodiment of the invention includes a color gamut expansion and preferred color correcting unit 10, a timing controller 11, a data drive circuit 12, a gate drive circuit 13, a liquid crystal display panel 16, a backlight unit 17 underlying the liquid crystal display panel 16, and a module power unit 15.

The color gamut expansion and preferred color correcting unit 10 processes the color space conversion algorithm, the color gamut expansion algorithm, the preferred color mapping algorithm, and the color space inverse conversion algorithm computed in steps S1 to S6 as described above. The processing of the color gamut expansion and preferred color correcting unit 10 may be implemented through a lookup table, to which an input/output relationship between the above algorithms is set, and a memory storing parameters to be input to the lookup table. The color gamut expansion and preferred color correcting unit 10 may be represented by functional block diagrams shown in FIGS. 3 and 4.

The timing controller 11 supplies corrected digital video data N-data of 4 or more primary colors output from the color gamut expansion and preferred color correcting unit 10 to the data drive circuit 12 in a mini low voltage differential signaling (LVDS) interface standard. The timing controller 11 receives timing signals, such as a vertical sync signal Vsync, a horizontal sync signal Hsync, a data enable signal DE, and a dot clock CLK, from a system board 14. The timing controller 11 generates a data control signal SDC for controlling operation timing of the data drive circuit 12 and a gate control signal GDC for controlling operation timing of the gate drive circuit 13 using the timing signals Vsync, Hsync, DE, and CLK. The timing controller 11 may multiply a frequency of each of the data control signal SDC and the gate control signal GDC based on a frame frequency of (60×i) Hz (where "i" is a positive integer equal to or greater than 2), so that digital video data input at a frame frequency of 60 Hz can be reproduced in a pixel array of the liquid crystal display panel 16 at the frame frequency of (60×i) Hz.

The data control signal SDC includes a source start pulse SSP, a source sampling clock SSC, a source output enable signal SOE, a polarity control signal POL, and the like. The source start pulse SSP controls a start time point of a data sampling operation of the data drive circuit 12. The source sampling clock SSC controls a data sampling operation inside source driver integrated circuits (ICs) of the data drive circuit 12 based on a rising or falling edge. If the timing controller 11 transfers the digital video data N-data to the source driver ICs of the data drive circuit 12 in a mini LVDS interface manner, the source start pulse SSP and the source sampling clock SSC do not need to be input to the source driver ICs. The polarity control signal POL inverts a polarity of a data voltage output from the data drive circuit 12 every N horizontal periods, where N is a positive integer. The source output enable signal SOE controls output timing of the data drive circuit 12. When a polarity of the data voltage supplied to data lines D1 to Dm is inverted, each of the source driver ICs supplies a charge share voltage or a common voltage Vcom to the data lines D1 to Dm in response to a pulse of the source output enable signal SOE and supplies the data voltage to the data lines D1 to Dm during a low logic period of the source output enable signal SOE. The charge share voltage is an average voltage of the neighboring data lines to which the data voltages with opposite polarities are supplied.

The gate control signal GDC includes a gate start pulse GSP, a gate shift clock GSC, a gate output enable signal GOE, and the like. The gate start pulse GSP controls timing of a first gate pulse. The gate shift clock GSC is a clock for shifting the gate start pulse GSP. The gate output enable signal GOE controls output timing of the gate drive circuit 13.

The system board 14 is connected to a broadcast receiving circuit and an external video source interface circuit to transfer digital video data of three primary colors or multi-primary colors received from the broadcast receiving circuit and the external video source interface circuit to the color gamut expansion and preferred color correcting unit 10 through a LVDS interface transmitting circuit or a transition minimized differential signaling (TMDS) interface transmitting circuit. The system board 14 transfers the timing signals, such as the vertical sync signal Vsync, the horizontal sync signal Hsync, the data enable signal DE, and the dot clock CLK to the timing controller 11. The system board 14 includes a graphic processing circuit, such as a scaler, and a power circuit. The graphic processing circuit interpolates a resolution of the digital video data received from the broadcast receiving circuit or the external video source interface circuit in conformity with a resolution of the liquid crystal display panel 16 and performs a signal interpolation processing on the digital video data. The power circuit produces a voltage Vin to be supplied to the module power unit 15.

The data drive circuit 12 includes a plurality of source driver ICs. Each of the source driver ICs samples and latches the corrected digital video data N-data of multi-primary color input from the timing controller 11 in response to the data control signal SDC received from the timing controller 11 to convert the corrected digital video data N-data of multi-primary color into parallel data. Each of the source driver ICs converts the deserialized correction digital video data N-data of multi-primary color into an analog gamma compensation voltage using positive or negative gamma reference voltages VGMA1 to VGMA10 from the module power unit 15 to generate a positive or negative analog video data voltage to which the liquid crystal cells will be charged. While each of the source driver ICs inverts a polarity of the positive/negative analog video data voltage under the control of the timing controller 11, each of the source driver ICs supplies the positive/negative analog video data voltage to the data lines D1 to Dm.

The gate drive circuit 13 includes a plurality of gate driver ICs. Each of the gate driver ICs includes a shift register sequentially shifting a gate driving voltage in response to the gate control signal GDC from the timing controller 11 to sequentially supply a gate pulse (i.e., a scan pulse) to the gate lines G1 to Gn.

The liquid crystal display panel 16 includes an upper glass substrate and a lower glass substrate that are positioned opposite each other with a liquid crystal layer interposed between the upper glass substrate and the lower glass substrate. The liquid crystal display panel 16 includes a pixel array displaying video data. The pixel array of the lower glass substrate includes a TFT formed at each of crossings of the data lines D1 to Dm and the gate lines G1 to Gn and pixel electrodes 1 connected to the TFTs. The pixel array includes a plurality of pixels each including subpixels of 4 or more colors. For example, each of the pixels includes an R subpixel, a G subpixel, and a B subpixel and further includes at least one of a C subpixel, a Y subpixel, and an M subpixel. The liquid crystal display panel 16 displays an image of the video data through a control of a transmitted amount of light provided by a backlight unit 17 by driving each of liquid crystal cells Clc of the pixel array by a difference between the data voltage applied to the pixel electrodes 1 through the TFTs and the common voltage Vcom applied to a common electrode 2 through the TFT.

A black matrix, a color filter, and the common electrode 2 are formed on the upper glass substrate of the liquid crystal display panel 16. The common electrode 2 is formed on the upper glass substrate in a vertical electric field driving manner, such as a twisted nematic (TN) mode and a vertical alignment (VA) mode. The common electrode 2 and the pixel electrode 1 are formed on the lower glass substrate in a horizontal electric field driving manner, such as an in-plane switching (IPS) mode and a fringe field switching (FFS) mode.

Polarizing plates are respectively attached to the upper and lower glass substrates of the liquid crystal display panel 16. Alignment layers for setting a pre-tilt angle of liquid crystals are respectively formed on the upper and lower glass substrates.

The liquid crystal display panel 16 applicable to the embodiment of the invention may be implemented in any liquid crystal mode as well as the TN, VA, IPS, and FFS modes. The liquid crystal display according to the embodiment of the invention may be implemented in any type liquid crystal display including a backlit liquid crystal display, a transflective liquid crystal display, and a reflective liquid crystal display. A backlight unit is necessary in the backlit liquid crystal display and the transflective liquid crystal display. The backlight unit 17 may be implemented as a direct type backlight unit or an edge type backlight unit.

The module power unit 15 adjusts the voltage Vin received from the power circuit of the system board 14 to generate a driving voltage of the liquid crystal display panel 16. The driving voltage of the liquid crystal display panel 16 includes a high potential source voltage Vdd equal to or less than 8V, a logic source voltage Vcc of about 3.3V, a gate high voltage VGH equal to or greater than 15V, a gate low voltage VGL equal to or less than −3V, the common voltage Vcom of 7V-8V, the positive or negative gamma reference voltages VGMA1 to VGMA10, etc.

Figure 3:
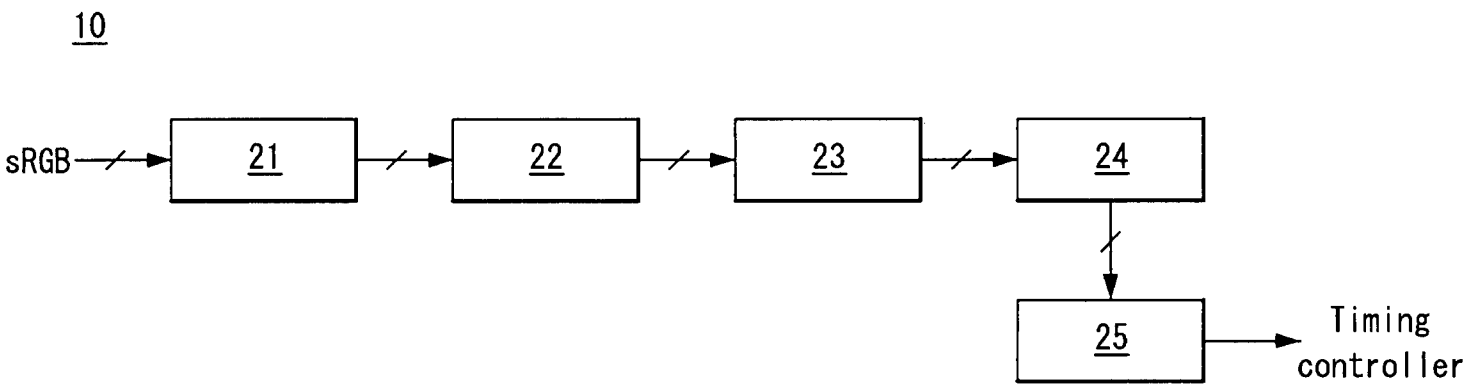
FIGS. 3 and 4 are block diagrams illustrating a color gamut expansion and preferred color correcting unit.
Figure 4:
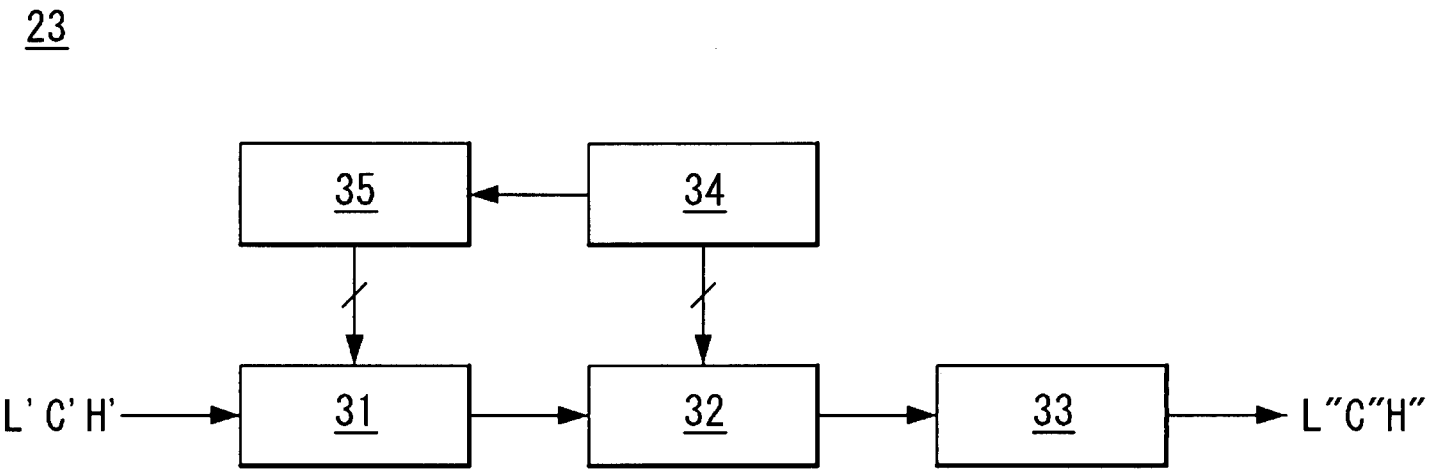

FIGS. 3 and 4 are block diagrams illustrating in detail the color gamut expansion and preferred color correcting unit 10.

As shown in FIGS. 3 and 4, the color gamut expansion and preferred color correcting unit 10 includes a color space converting unit 21, a color gamut expansion unit 22, a preferred color correcting unit 23, a color space inverse converting unit 24, and a color signal separating unit 25.

The color space converting unit 21 converts multi-primary color data of three or four or more primary colors into XYZ color values specified in an XYZ color space using the color space conversion algorithms indicated in the above Equations 1 to 8 and then converts the XYZ color values into LCH color values specified in an LCH color space.

The color gamut expansion unit 22 expands a color gamut of each of the LCH color values using the color gamut expansion algorithm indicated in the above Equation 9. The preferred color correcting unit 23 receives parameters determined by preliminarily recognition experiments irrespective of an input image and color gamut expansion data to correct a preferred color using the preferred color correction algorithms indicated in the above Equations 10 and 11.

The color space inverse converting unit 24 inversely converts the LCH color values into the XYZ color values. The color signal separating unit 25 converts the XYZ color values inversely converted by the color space inverse converting unit 24 into multi-primary color data N_data, S1-Sn.

The preferred color correcting unit 23, as shown in FIG. 4, includes a preferred color region detecting unit 31, a preferred color correction amount calculating unit 32, a parameter storing unit 34, a Gaussian probability model processing unit 35, and a preferred color correcting unit 33.

The preferred color region detecting unit 31 adds (or multiplies) a weight value w received from the Gaussian probability model processing unit 35 to the input image of the LCD color values to detect a preferred color region to be corrected. The preferred color correction amount calculating unit 32 receives parameters received from the parameter storing unit 34 and data of the preferred color region from the preferred color correcting unit 33 to process a calculation required in the preferred color mapping algorithm indicated in the above Equation 11.

The parameters stored in the parameter storing unit 34 are previously set to values optimized through the preliminarily recognition experiments irrespective of the input image. The Gaussian probability model processing unit 35 calculates the weight value w to be corrected through the preferred color mapping algorithm indicated in the above Equation 10, that is a function obtained using the parameters received from the parameter storing unit 34, to input the weight value w to the preferred color region detecting unit 31.

The preferred color correcting unit 33 corrects data of the preferred color region, whose a color gamut is expanded, using an output of the preferred color correction amount calculating unit 32.

Although FIG. 2 shows the AM TFT LCD, the correcting method of the preferred color according to the embodiment of the invention may be applied to other display devices, such as a field emission display (FED), a plasma display panel (PDP), and an electroluminescence device (EL) as well as the AM TFT LCD.

As described above, in the correcting method of the preferred color according to the embodiment of the invention, the display quality of the preferred color of the multi-primary color display can be improved without converting additional color spaces by sequentially applying the color gamut expansion algorithm and the preferred color mapping algorithm to the uniform color space. Furthermore, in the correcting method of the preferred color according to the embodiment of the invention, because the parameters for correcting the preferred color are previously determined by the preliminarily recognition experiments, the color gamut expansion algorithm for multi-primary color gamut, the preferred color mapping algorithm for image quality preference improvement, and the color signal conversion algorithm for multi-primary color processing can be implemented as a lookup table without performing the analysis process of the input image. Hence, the color gamut expansion and the preferred color correction can be real-time processed.

Although embodiments have been described with reference to a number of illustrative embodiments thereof, it should be understood that numerous other modifications and embodiments can be devised by those skilled in the art that will fall within the scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A method of correcting a preferred color comprising:

converting an input image including multi-primary color data of three or more primary colors into an XYZ color space and converting the XYZ color space into data of an LCH color space including a lightness, a chroma and a hue;

expanding a color gamut of the data in the LCH color space to detect a preferred color region of the color gamut expansion data and correcting the lightness, the chroma, and the hue of the preferred color region using parameters independent of the input image, wherein the parameters have been preliminarily determined and previously stored, and includes a constant for adjusting a corrected amount of preferred color mapping, an average value of preferred color distributions, a standard deviation value of the preferred color distributions, and a corrected target value of the preferred color in a multi-primary color display, and wherein the correcting is performed, in part, by multiplying the constant by the difference between the corrected target value and the average value;

inversely converting the corrected data of the preferred color region of the color gamut expansion data into an XYZ color space and dividing the XYZ color space into multi-primary color data of four or more primary colors; and displaying the multi-primary color data on the multi-primary color display.

2. The method of claim 1, wherein the multi-primary color data includes red data, green data, blue data, and cyan data.

3. The method of claim 2, wherein each pixel of the display device includes four subpixels respectively corresponding to the red data, the green data, the blue data, and the cyan data.

4. A display device comprising:

a display panel that displays multi-primary color data of four or more primary colors;

a display panel driving circuit that displays the multi-primary color data on the display panel;

a storing unit that stores parameters independent of an input image, wherein the parameters have been preliminarily determined and previously stored; and a color gamut expansion and preferred color correcting unit that receives an input image including multi-primary color data of three or more primary colors to convert data of the input image into an XYZ color space, converts the XYZ color space into data of an LCH color space including a lightness, a chroma and a hue, expands a color gamut of the data of the input image in the LCH color space, corrects the lightness, the chroma, and the hue of a preferred color region using the parameters, and divides the corrected data of the preferred color region into multi-primary color data of four or more primary colors to supply the multi-primary color data to the display panel driving circuit, wherein the parameters includes a constant for adjusting a corrected amount of preferred color mapping, an average value of preferred color distributions, a standard deviation value of the preferred color distributions, and a corrected target value of the preferred color in the display panel, and wherein the correcting is performed, in part, by multiplying the constant by the difference between the corrected target value and the average value.

5. The display device of claim 4, wherein the multi-primary color data includes red data, green data, blue data, and cyan data.

6. The display device of claim 5, wherein each pixel of the display device includes four subpixels respectively corresponding to the red data, the green data, the blue data, and the cyan data.

7. The display device of claim 4, wherein the display panel includes a display panel of one of a liquid crystal display, a field emission display, a plasma display panel, and an electroluminescence device.

* * * * *